US008381419B2

(12) United States Patent
Fenato et al.

(10) Patent No.: US 8,381,419 B2
(45) Date of Patent: Feb. 26, 2013

(54) SKI BOOT, IN PARTICULAR ALPINE SKI BOOT

(75) Inventors: Piero Fenato, Caerano di San Marco (IT); Mario Sartor, Volpago del Montello (IT)

(73) Assignee: Ober ALP S.p.A., Bolzano (IT)

( * ) Notice: Subject to any disclaimer, the term of this patent is extended or adjusted under 35 U.S.C. 154(b) by 417 days.

(21) Appl. No.: 12/892,700

(22) Filed: Sep. 28, 2010

(65) Prior Publication Data

US 2011/0083342 A1 Apr. 14, 2011

(30) Foreign Application Priority Data

Oct. 13, 2009 (IT) ..... VE2009A0061

(51) Int. Cl.
*A43B 23/26* (2006.01)

(52) U.S. Cl. ..... 36/54; 36/117.4; 36/118.2

(58) Field of Classification Search ..... 36/117.4, 36/118.2, 54, 117.1, 117.6
See application file for complete search history.

(56) References Cited

U.S. PATENT DOCUMENTS 4,928,405 A * 5/1990 Spademan ..... 36/50.1
5,174,050 A * 12/1992 Gabrielli ..... 36/117.6
5,265,353 A * 11/1993 Marega et al. ..... 36/54
5,490,337 A 2/1996 Zerbinati
5,553,402 A 9/1996 Marega
7,941,944 B2 * 5/2011 Cagliari ..... 36/54
8,181,366 B2 * 5/2012 Sartor et al. ..... 36/117.1
2002/0053147 A1 * 5/2002 Borsoi et al. ..... 36/54
2005/0204585 A1 * 9/2005 Loveridge et al. ..... 36/54

FOREIGN PATENT DOCUMENTS

DE 3247206 A1 7/1983
EP 0672364 A2 9/1995
WO 0033692 A1 6/2000

OTHER PUBLICATIONS

Italian Ministry of Economic Development, Search Report (Produced by the European Patent Office on May 20, 2010).

* cited by examiner

*Primary Examiner* — Ted Kavanaugh
(74) *Attorney, Agent, or Firm* — Themis Law

(57) ABSTRACT

A ski boot includes a base shell; a sole; an upper shell that has at least a fastening clip and that is articulated to the base shell with pins provided in the region of the malleoli; an inner boot, wherein the base shell defines a slot having two strips coupled one to the other with a gaiter and is provided with at least one fastening device; a first tongue joined to the base shell in the proximity of a tip thereof, the first tong being manufactured from a material of differentiated rigidities, the portion of the first tongue in the area of the free end having a lower rigidity that the portion joined to the base shell; and a removable second tongue configured to cover the first tongue and having a greater rigidity than the first tongue.

6 Claims, 4 Drawing Sheets

SKI BOOT, IN PARTICULAR ALPINE SKI BOOT

FIELD OF THE INVENTION

The present invention relates to a ski boot, and in particular to an alpine ski boot.

BACKGROUND OF THE INVENTION

Ski boots are known that include a base shell made from a plastic material, a sole, an upper shell articulated to the base shell with pins positioned in the region of the malleoli, and a padded inner boot.

The base shell defines a longitudinal slot having two strips extending therefrom that are connected one to the other by a gaiter made in a plastic material and that operate as a seal against snow and moisture.

Two or more clips applied respectively on the upper and on the base shells enable a clamping of the user's leg and foot.

Yet this known type of boot exhibits the drawback of stiffening the base shell unreliably during the forward and backward flexing of the base shell occurring during downhill skiing.

SUMMARY OF THE INVENTION

It is an object of the present invention to overcome the above drawback and to provide an alpine ski boot having a base shell that stiffens reliably during downhill skiing, and at the same time flexes forward and backward comfortably during walking.

The above object is attained by a ski boot according to the invention that includes:

a base shell;

a sole, an upper shell that includes at least a fastening device and that is articulated to the base shell with pins positioned in the region of the malleoli, a padded inner boot, wherein the base shell defines a longitudinal slot having two strips extending therefrom that are connected one to the other by a gaiter and further having at least a closing device, a first tongue coupled to the base shell near the tip thereof, the first tong being manufactured from a material having a differentiated stiffness, the portion at the free end of the first tongue having a lower stiffness than the opposite portion connected to the base shell, and a removable second tongue that covers the first tongue, the second tongue having a higher stiffness than the first tongue.

BRIEF DESCRIPTION OF THE DRAWINGS

The present invention is described in the form of a preferred embodiment, which should be understood to be exemplary and non-limiting in nature, and also with reference to the enclosed drawings, in which.

DETAILED DESCRIPTION OF AN EXEMPLARY EMBODIMENT

Figure 1:
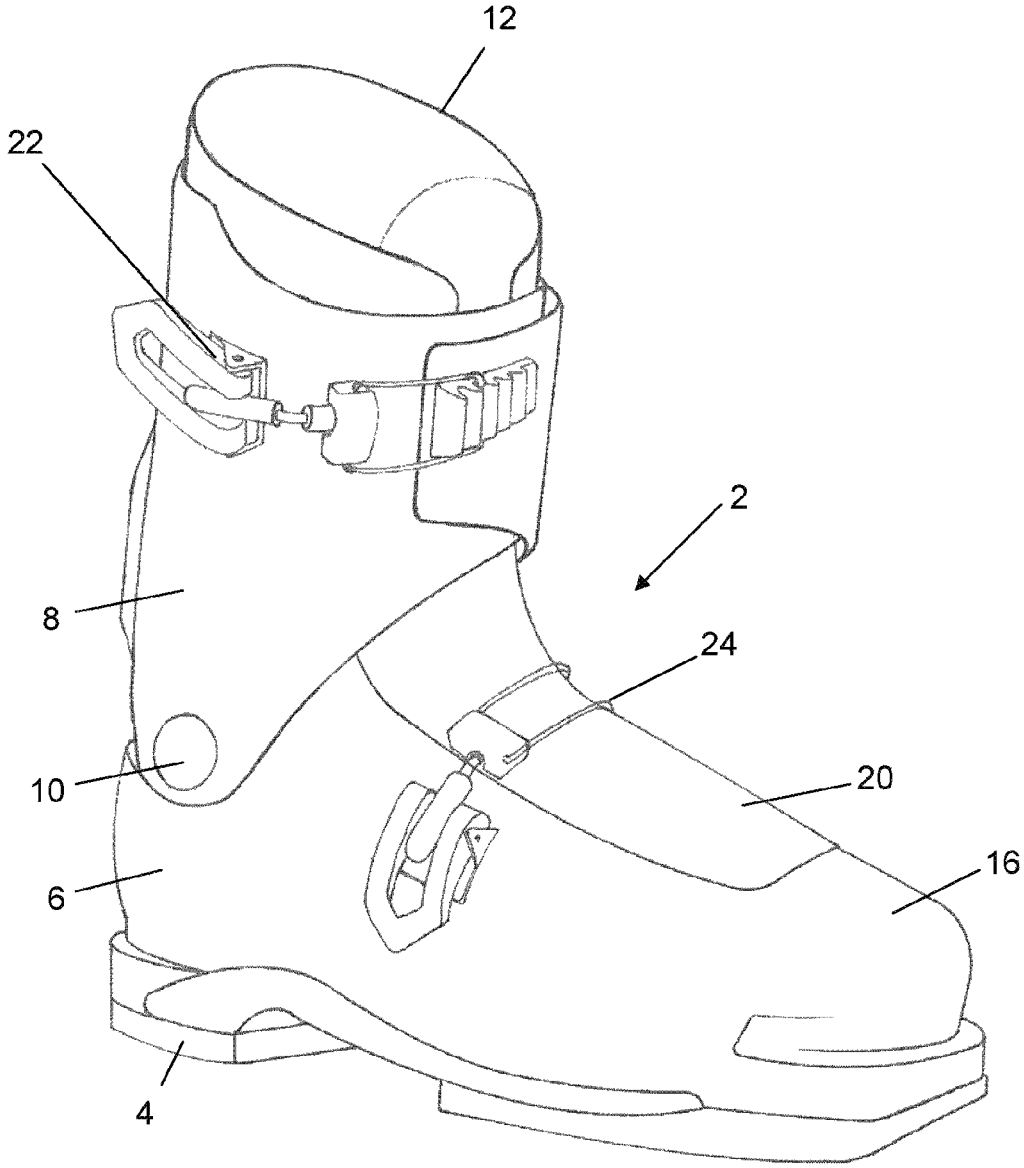
FIG. 1 is a perspective view of a traditional ski boot.
Figure 2:
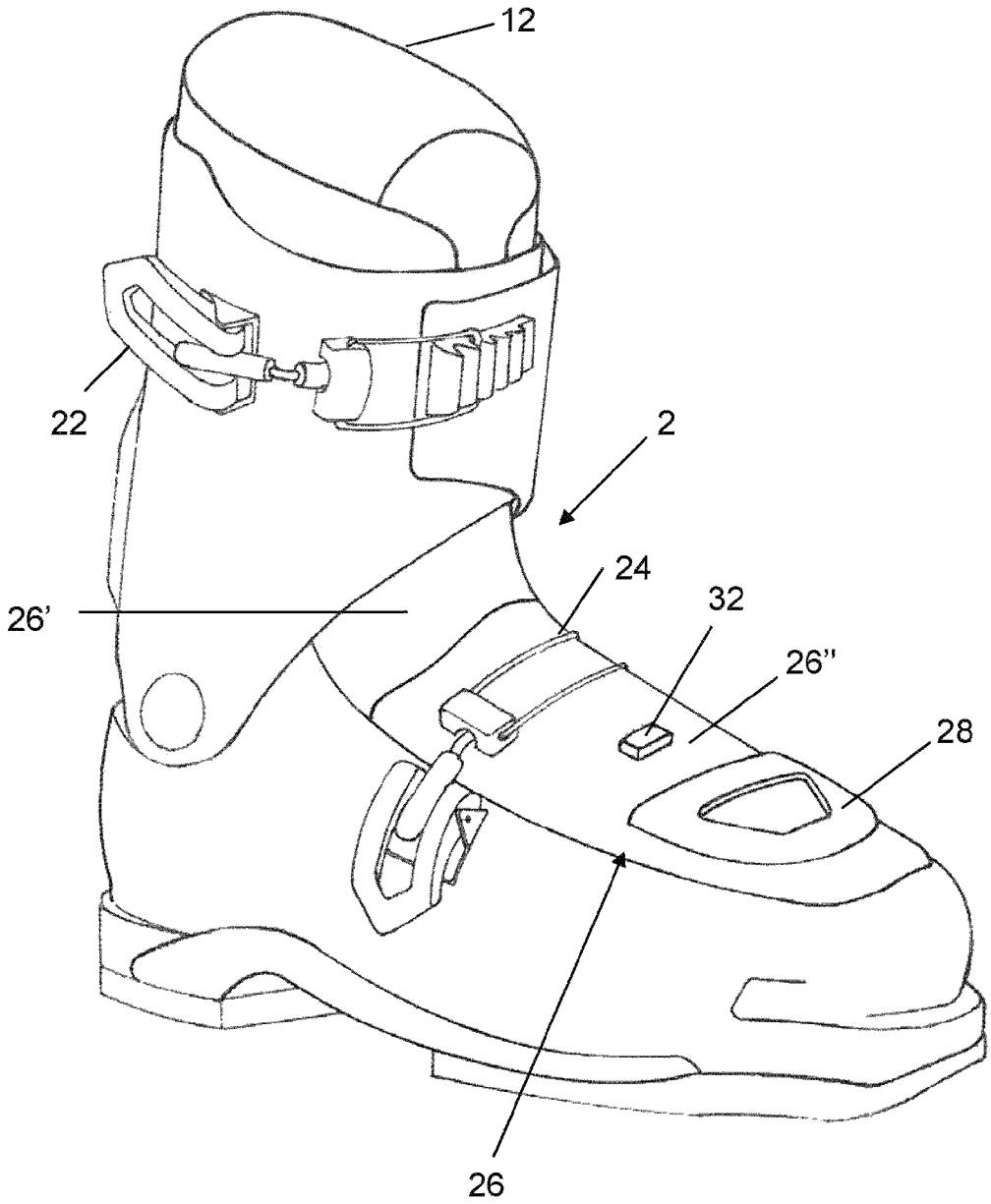
FIG. 2 shows the ski boot of FIG. 1 with the addition of a first tongue according to the invention.
Figure 3:
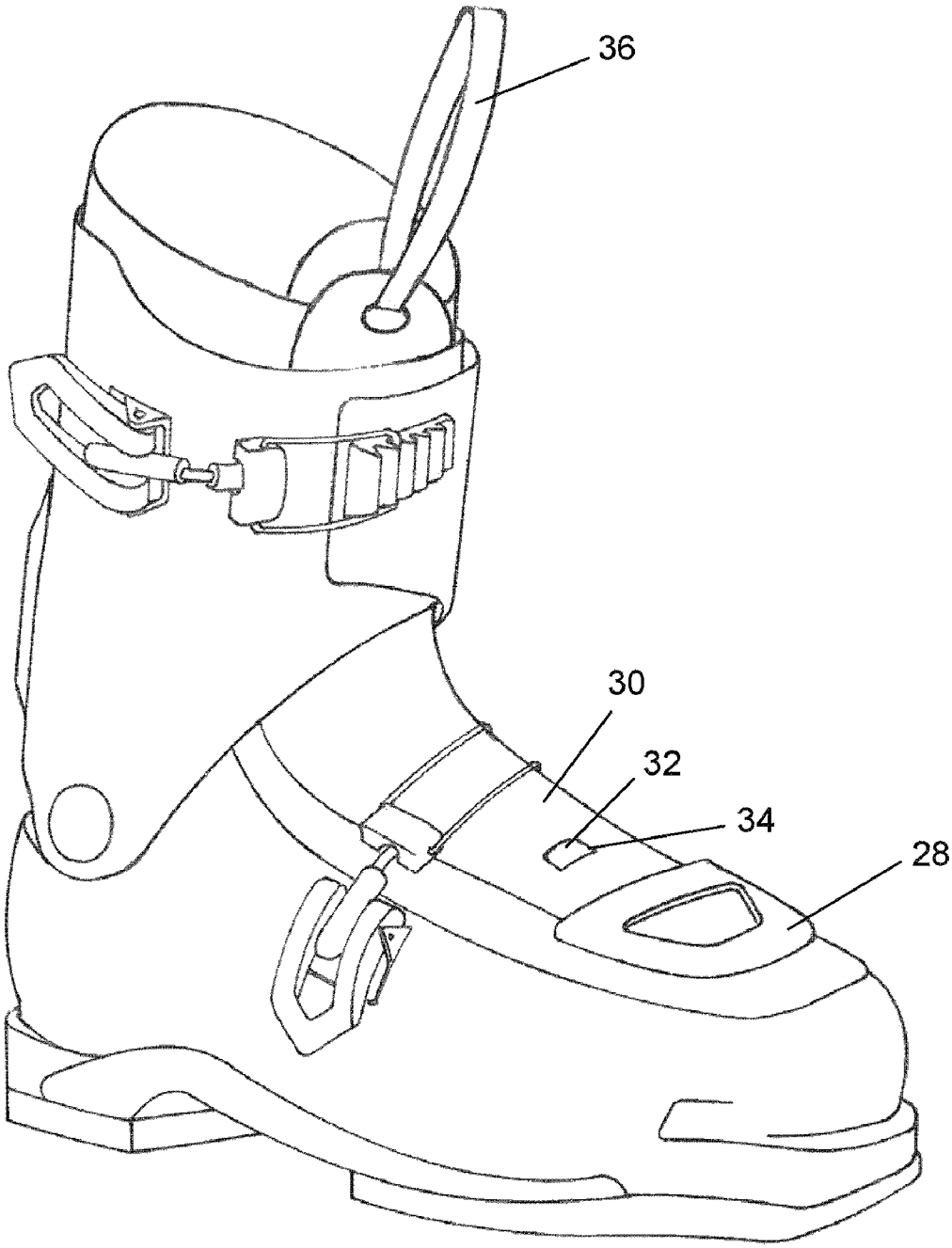
FIG. 3 shows the ski boot of FIG. 1 with the addition of a second tongue according to the invention.
Figure 4:
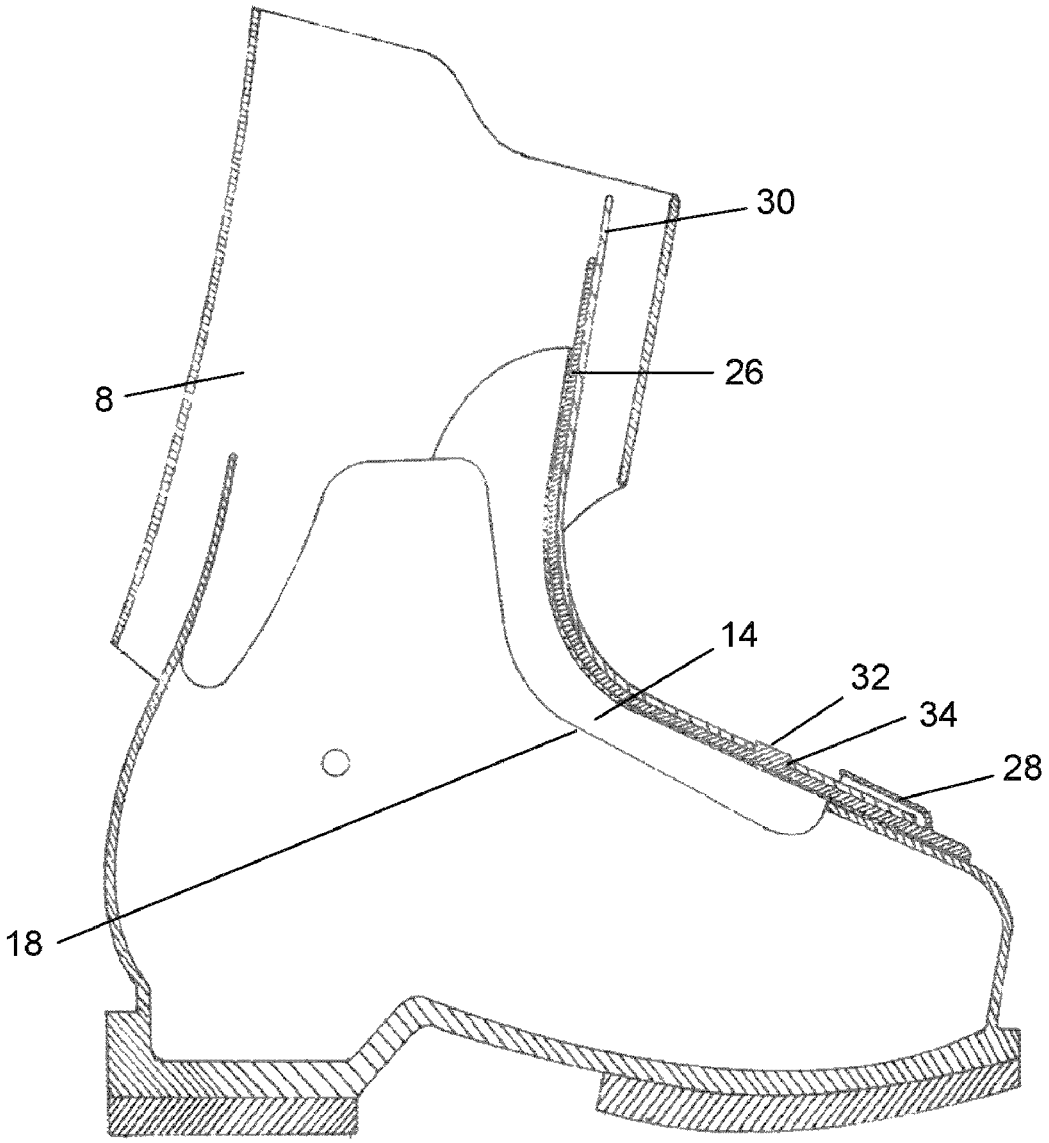
FIG. 4 is a cross-sectional view of a ski boot according to the invention.

With reference to FIGS. 1-4, a boot according to the invention is identified with numeral 2 and may be configured as a boot for alpine skiing, telemark or free ride.

Boot 2 includes a sole 4, a base shell 6 made from a rigid plastic or composite material, and an upper shell 8 made from a plastic or composite material that is articulated to base shell 6 with pins 10 disposed in the region of the malleoli.

A padded inner boot having a tongue is disposed inside base shell 6.

Base shell 6 defines a longitudinal slot 16 that essentially extends to the region of tip 16 and that has two parallel strips 18 extending therefrom and coupled one to the other by a gaiter 20, such to provide a seal against the entry of snow and water.

Two traditional fastening clips 22 and 24 operate as closure devices and are coupled respectively to upper shell 8 and to base shell 6. Upon closing, fastening clips 22 and 24 enable a clamping of the leg and foot of the skier.

A first tongue 26, covering gaiter 20, is coupled to tip 16. First tongue 16 is manufactured from a material having differentiated rigidity, and in particular a rigidity of about 40 Shore D at the free end of first tongue 26 till clip 24, and a rigidity of about 60 Shore for the remaining part of first tongue 26.

A pocket 28 is applied to first tongue 26, in order to removably insert therein the extremity of a second tongue 30 having a rigidity of about 70 Shore D.

First tongue 26 includes, in the portion facing second tongue 30, a pin 32 that engages a corresponding seat 34 defined in second tongue 30.

A method of use of a boot according to the invention includes the following steps.

When walking, the skier wears the boot only with first tongue 26. Second tongue 30 may be engaged to a backpack, or to the belt of the skier by means of a flexible ring 36.

During this step, the specific construction of first tongue 26 in two portions of different rigidities enables an easy forward and backward flexing of the leg by the skier, but at the same time insures a reliable blocking of the instep against undesired torsions.

When the skier begins skiing downhill, she inserts second tongue 30 within pocket 28 of first tongue 26, such to increase total stiffness of the shoe.

Engaging pin 32 with seat 34 prevents the accidental disengagement of second tongue 30 from pocket 28.

The present invention has been described and illustrated in the form of a preferred embodiment, but it should be understood that other embodiments are possible and still within the scope of the present industrial invention.

What is claimed is:

1. A ski boot comprising:

a base shell;

a sole;

an upper shell comprising at least a fastening clip, the upper shell being articulated to the base shell with pins disposed in the region of the malleoli, wherein the base shell defines a longitudinal slot exhibiting two strips coupled one to the other with a gaiter, the base shell having at least a closure device;

a padded inner boot;

a first tongue joined to the base shell near a tip thereof, the first tongue having a differentiated rigidity, a first portion of the first tongue that has a free end having a lower rigidity than an opposite second portion of the first tongue that is joined to the base shell; and a removable second tongue disposable to cover the first tongue, the second tongue having a higher rigidity than the first tongue.

2. The ski boot of claim 1, wherein the ski boot includes a plurality of closure devices, and wherein the rigidity of the first tongue varies in the proximity of the closure device furthest from the tip of the base shell.

3. The ski boot of claim 1, wherein the first portion of the first tongue has a rigidity of about 40 Shore D and the second portion of the first tongue has a rigidity of about 60 Shore D.

4. The ski boot of claim 1, wherein the first tongue includes a pocket configured to removably house an extremity of the second tongue.

5. The ski boot of claim 4, wherein the second tongue has a rigidity of about 70 Shore D.

6. The ski boot of claim 1, wherein the first tongue comprises a tongue pin disposed to face the second tongue, the tongue pin being configured to engage a corresponding seat defined in the second tongue.

* * * * *